United States Patent [19]

Sears et al.

[11] Patent Number: 4,555,814

[45] Date of Patent: Dec. 3, 1985

[54] METHOD OF FORMING CLOTH INTO THREE-DIMENSIONAL SHAPES AND THE ARTICLES PRODUCED BY THAT METHOD

[75] Inventors: I. Weir Sears, Davenport; John E. Hostetler, Bettendorf; William H. Hulsebusch, Dewitt, all of Iowa

[73] Assignee: Apparel Form Company, Davenport, Iowa

[21] Appl. No.: 596,025

[22] Filed: Apr. 2, 1984

Related U.S. Application Data

[60] Division of Ser. No. 393,824, Jul. 6, 1982, Pat. No. 4,459,704, which is a continuation-in-part of Ser. No. 289,254, Aug. 3, 1981, abandoned.

[51] Int. Cl.[4] ..... A41B 1/00; A41D 1/06

[52] U.S. Cl. ..... 2/227; 2/243 R

[58] Field of Search ..... 2/227, 243 R, 409, 69; 66/177; 26/69 A, 69 B; 38/144; 264/231, 239, 291, 292, 299

[56] References Cited

U.S. PATENT DOCUMENTS

| | | |
|---|---|---|
| 139,283 | 5/1873 | Viets . |
| 156,900 | 11/1874 | Viets . |
| 373,379 | 11/1887 | Rupprecht . |
| 612,281 | 10/1898 | Smith . |
| 1,722,697 | 7/1929 | Glidden et al. . |
| 1,981,949 | 11/1934 | DeWitt . |
| 2,022,210 | 11/1935 | Leef et al. . |
| 2,080,823 | 5/1937 | Jessen . |
| 2,180,939 | 11/1939 | Leef . |
| 2,603,390 | 7/1952 | Kaufman . |
| 2,616,084 | 11/1952 | Shearer . |
| 2,907,074 | 10/1959 | Rhodes . |
| 2,956,714 | 10/1960 | Rosenthal et al. . |
| 2,986,777 | 6/1961 | Carter . |
| 2,995,781 | 8/1961 | Sipler . |
| 3,181,749 | 5/1965 | Helliwell et al. . |
| 3,239,586 | 3/1966 | Adams . |
| 3,331,906 | 7/1967 | Adams . |
| 3,472,434 | 10/1969 | Cherry et al. . |
| 3,473,707 | 10/1969 | James . |
| 3,477,621 | 11/1969 | Forse . |
| 3,535,418 | 10/1970 | Daum et al. . |
| 3,550,820 | 12/1970 | O'Boyle . |
| 3,556,361 | 1/1971 | O'Boyle . |
| 3,558,760 | 1/1971 | Olson . |
| 3,646,646 | 3/1972 | Koizumi et al. . |
| 3,655,858 | 4/1972 | Wincklhofer et al. . |
| 3,673,611 | 7/1972 | Cain et al. . |
| 3,751,778 | 8/1973 | Grosjean et al. . |
| 3,763,499 | 10/1973 | Bartos et al. . |
| 3,819,638 | 6/1974 | Ogawa et al. . |
| 3,868,214 | 2/1975 | Shackleton . |
| 3,892,342 | 7/1975 | Ogawa et al. . |
| 3,918,876 | 11/1975 | Rose . |
| 4,103,363 | 8/1978 | Conner, Jr. . |
| 4,171,076 | 10/1979 | Conner, Jr. . |
| 4,199,089 | 4/1980 | Rilkow et al. . |
| 4,247,347 | 1/1981 | Lischer et al. . |
| 4,247,348 | 1/1981 | Lischer . |
| 4,264,386 | 4/1981 | Sears, Jr. et al. . |

*Primary Examiner*—H. Hampton Hunter

*Attorney, Agent, or Firm*—Niro, Scavone, Haller & Niro

[57] ABSTRACT

A novel process is disclosed in which garments and other cloth items are formed into their predetermined three dimensional shapes. Unfinished cloth is used to construct a shell which is then completely finished while maintained in the shape of the final product on a mold. The invention is also directed to the products obtained from the novel process and to the one-piece pattern used in the manufacture of pant garments in accord with the process of the present invention.

6 Claims, 6 Drawing Figures

FIG. 1
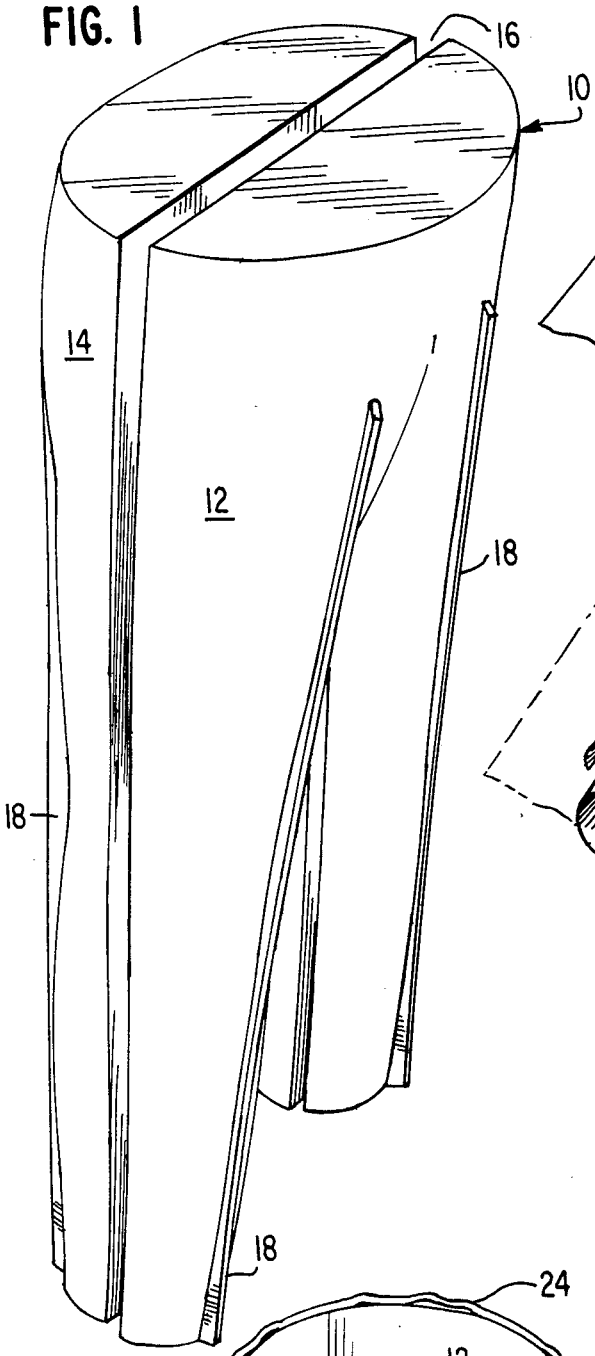
FIG. 2
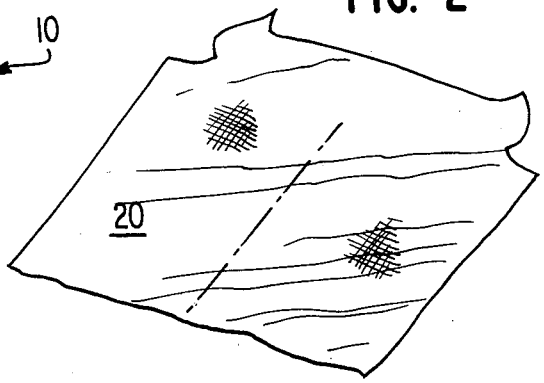
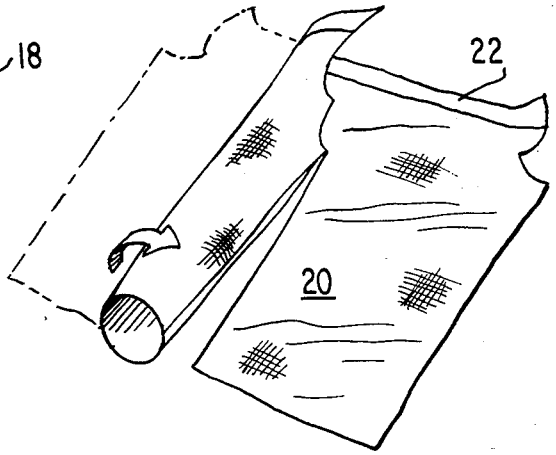
FIG. 3
FIG. 5
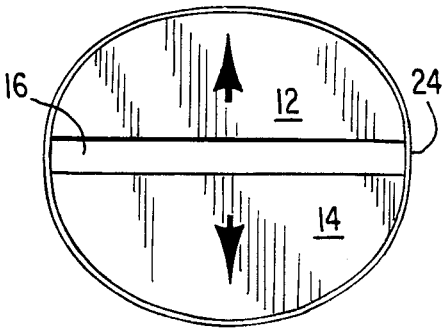
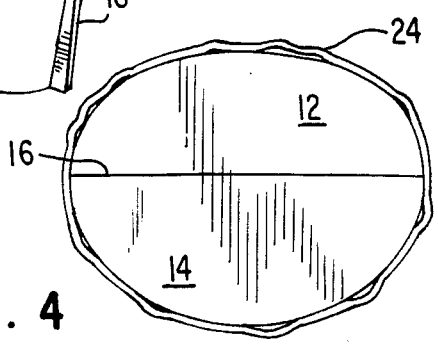
FIG. 4

METHOD OF FORMING CLOTH INTO THREE-DIMENSIONAL SHAPES AND THE ARTICLES PRODUCED BY THAT METHOD

REFERENCE TO RELATED APPLICATION

This is a division of application Ser. No. 393,824 filed July 6, 1982, now U.S. Pat. No. 4,459,704 dated July 17, 1984, which in turn is a continuation-in-part of application Ser. No. 289,254, filed Aug. 3, 1981, now abandoned.

BACKGROUND OF THE INVENTION

This invention relates to a method of forming cloth, and more particularly, to a method of forming cloth shells into garments or other three-dimensional shapes. This invention also relates to the garments or other cloth products manufactured by this new and unique method.

In recent years there has been an ever increasing demand for relatively low cost, ready-to-wear garments that have a fine, tailored appearance and that are capable of retaining that appearance after extended wear. As a result, a variety of synthetic materials have been incorporated into cloth, either alone or blended with natural fibers, to produce such garments. These fabrics, however, along with natural fabrics such as cotton and wool, must still be made into a garment by conventional cutting, sewing and pressing techniques that are both time consuming and labor intensive. Thus, the costs of manufacturing garments having a fine appearance have not been satisfactorily reduced.

The conventional method of making cloth garments begins with cutting the cloth, in the flat, into a number of pieces which are arranged according to a predetermined, often complex pattern. In order to minimize cutting costs, many layers of cloth are cut to the desired pattern at one time. This procedure, however, introduces size variations in the pieces, since the cutting knive may not hold precisely to the true garment pattern through the multiple layers of cloth. As a consequence, undesirable variations in the size and configuration of the final garment occur. Conventional garment manufacture also requires that the cloth pieces of the pattern be joined or seamed, by sewing or welding, and darts are typically employed where necessary to shape the garment. This is followed by pressing to improve fit and remove wrinkles. All of these steps are labor intensive and therefore expensive.

In addition, the seams of conventionally tailored garments may pucker or open during manufacture or after extended wear and cleaning. Even if the seams do not open or pucker, they nevertheless constitute rigid intersections in the garment which tend to lessen the garment's wearing comfort. Furthermore, even with multiple seams and darts, it is extremely difficult to produce a garment which faithfully conforms to the predetermined size and configuration of the desired apparel.

Because of the inherent disadvantages in conventional garment fabrication procedures, attempts have been made in the past to form garments by molding processes. If a practical and efficient method of molding cloth into garments or other products could be developed, many of the inherent drawbacks of the present cutting and sewing or welding techniques could be eliminated. Molded garments, for example, would be more economical to produce than garments produced in accordance with traditional manufacturing techniques since the number of labor intensive steps employed in conventional techniques would be reduced, and consistency of sizing in the molded garments would be far superior to traditionally manufactured garments, since size variations in the garment prior to molding would be eliminated.

Molded garments require far fewer seams and darts than traditionally manufactured garments. This reduces the problem of opened and puckered seams, and greatly improves the garment's wearing comfort and durability, particularly after extended wear and cleaning.

In addition, molded garment manufacture can provide improved appearance in the final product, particularly with plaids and other patterned fabrics, while at the same time reducing costs by minimizing both labor and the amount of material required to produce a finished product.

While others have suggested various methods for molding garments and other cloth products, these methods all suffer serious drawbacks. Examples of such prior art processes are disclosed in U.S. Pat. Nos. 3,655,858; 3,763,499; 3,819,638; 3,892,342; 4,103,363 and 4,171,076. These prior art processes are directed primarily to molding or forming knitted fabrics, and they all suffer from the disadvantages that (1) the shell of cloth made before molding does not conform to the general shape of the final molded article, (2) finished fabrics that have already been tentered in the flat are used in the molding process and (3) the garment is not molded under uniform tension and the finished garment therefore includes variations in the density of the fabric and an irregularity in sizing. In addition, these prior molding techniques have generally failed to produce garments which retain their molded shape, particularly after extended wear and cleaning. Moreover, because these prior art processes are directed to molding finished cloth which has already been subjected to dimensional-setting treatments while in the flat, the molding process does not provide either a precise sizing of the finished garment or satisfactory stretch and comfort characteristics.

Two particularly important finishing steps typically performed at the mill are the dyeing and tentering of the cloth. The dyeing step in some instances involves the application of heat to the fabric, which in thermoplastic fabrics tends to set the intersections of the individual yarns. The tentering process involves the application of both tension and heat to set the intersections of the individual yarns. In either case, however, the fabric is not uniformly tensioned, set, dyed or tentered while in the general shape of the finished garment itself. Prior art molding processes typically utilize dyed and tentered goods, failing to recognize the advantages of working with goods which are not completely finished or greige goods which come right off the loom or knitting machine prior to the application of any finishing processes.

As indicated above, the prior art cloth molding processes fail to maintain generally uniform tension across the circumference of the garment during molding. Many of these processes, for example, will stretch the garment in some places and shrink it in others or stretch the garment to differing degrees in different areas producing uneven tension and variations in fabric density throughout the garment, and hence, an unattractive, ill-fitting final product. Furthermore, it is often difficult and time consuming to achieve the balance of stretching and shrinking called for by these prior art processes.

The prior art has also failed to appreciate the significance of developing an appropriately shaped and sized pattern in order to achieve the necessary uniformity in tensioning required during molding. For example, the prior art illustrates only simple rectangular patterns or tubes of knitted material. As a consequence, the premolding cloth shells of the prior art do not conform to the shape and size of the final garment and must stretch, shrink or both stretch and shrink—and to differing degrees across the garment—during the molding process.

While cloth molding techniques of various types have been suggested, these techniques have not been commercially accepted. Garments molded according to the teaching of these techniques typically fail to hold their shape on extended wear and cleaning of the garments. Since the prior art has utilized only finished fabrics, the advantages of performing finishing operations on the garment while mounted on a mold have not been suggested or recognized. Indeed, the prior art has been concerned almost exclusively with molding knit fabric, failing to suggest practical ways in which woven and other non-knit fabrics may be molded.

In summary, none of the prior art garment molding processes provides either a practical or efficient method for apparel manufacture, and the garments resulting from these prior art processes are aesthetically unappealing, have insufficient stretch characteristics and are generally ill-fitting. As a consequence, no prior art garment molding processes have achieved any commercial acceptance.

SUMMARY OF THE INVENTION

The present invention provides a dramatic departure and advance over the prior art. Whereas the prior art has attempted to actually reshape the cloth shell via heat molding processes, the present invention utilizes unfinished cloth cut into a specially configured pattern or blank to thereby construct an appropriately sized and shaped, preformed cloth shell which generally maintains its size and shape throughout the process—but is placed under uniform tension on a similarly sized and shaped mold and then treated to completely finish and set the dimensional memory of the cloth.

Accordingly, it is an object of the present invention to provide a method of forming cloth to produce garments of excellent appearance which will reliably hold their original shape.

Another object of the present invention is to provide a method of molding woven and unfinished cloth to form cloth articles of a predetermined three-dimensional shape.

It is a further object of the present invention to provide a method of forming garments in which the process effecting the set or dimensional stability of the fabric is performed as the garment is maintained in a predetermined shape on a mold.

Yet another object of the present invention is to provide a method of forming garments from greige or partially unfinished cloth in which the garments are dyed during the forming process, before they are removed from the mold.

Another object of the present invention is to provide garments molded from preformed cloth shells into finished garments which conform more completely to industry accepted dimensions for standard garment sizes and to the contours of the human body.

Still another object of the invention is to form cloth into predetermined three-dimensional shapes by utilizing an expandable mold that places the cloth in uniform tension during the forming process.

A further object of the present invention is to provide a method of forming garments whereby at least some of the finishing treatments conventionally applied to the cloth in the flat are performed only while maintaining the cloth on a mold in the final shape of the garment.

Another object of the present invention is to provide a one-piece pattern for use in forming cloth into a pant garment wherein the pattern is specially configured to result in a premolding cloth shell having a size and shape closely approximating that of the final pant garment.

In accordance with these and other objects and advantages of the present invention which will become apparent upon reading the following detailed description, the present invention comprises a method of forming cloth into predetermined three-dimensional articles from cloth shells. More particularly, the method entails constructing a preformed cloth shell conforming to the shape of a mold contoured to correspond to the precise predetermined three-dimensional shape of the article, placing the cloth shell in tension over the mold and treating the cloth shell while on the mold so that the shell will retain the predetermined shape when removed from the mold.

The cloth shells used in the practice of the present invention are preferably constructed from the least number of pieces or "blanks" (preferably one) and joined by the least amount of stitching or welding possible. The shape of the cloth shell generally follows the shape of the mold so that substantially the entire shell will be placed under generally uniform tension—at least circumferentially—when it is mounted on the mold. An exemplary preformed cloth shell is described below.

In an important embodiment of the invention, the cloth shell is made of an unset woven fabric. In this embodiment, the shell is tentered on the mold; that is, heated to a temperature above its heat set threshold while under tension on the mold. After heating, the cloth shell is permitted to cool to a temperature sufficient to insure that it will retain its shape when removed from the mold. Alternatively, setting chemicals and other setting techniques may be applied to the tensioned, mold-mounted shell before it is removed to insure shape and dimensional stability. When heat setting is employed, the mold may be perforated to facilitate the heating and cooling processes.

In yet another embodiment of the invention, the cloth shell is made of an undyed polyester product which is dyed by first chemically treating the shell to lower the fabric heat history characteristics and hence its ability to absorb dye and then dipping the entire shell and mold into a dye bath. The mold is preferably perforated to facilitate the movement of dye across the mold and shell and to thereby assure uniform coloring both inside and outside of the garment, and in many instances the chemical treatment prior to dyeing is unnecessary, and hence not utilized.

In the latter embodiment of the invention, the setting step may be performed at the same time the cloth is dyed by heating the dye bath above the heat set threshold of the polyester fabric. In such cases the shell itself need not be uniformly pretensioned since tension is inherently created during the heating and dyeing operation. Alternatively, the cloth shell is dyed first, and the mold and shell are then heated in an oven maintained at a temperature above the heat set threshold. When chemicals, such as resins or cross linking agents are used to finish or set the cloth, the dyeing step may be performed either before or after the chemicals are applied, depending on the nature of the particular cloth, chemicals and dye which are used.

BRIEF DESCRIPTION OF DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

FIG. 1 is a perspective view of a mold which may be used in the practice of the present invention;

FIG. 2 is a perspective view of a cloth blank used in forming the preformed cloth shell in the practice of the present invention;

FIG. 3 is a perspective view showing the fabrication of a cloth shell from the blank illustrated in FIG. 2;

FIG. 4 is a top view of the mold of FIG. 1 in the retracted position with a cloth shell positioned on it;

FIG. 5 is a top view similar to that of FIG. 4, but showing the mold in expanded position with the cloth shell in uniform tension on the mold.

DESCRIPTION OF THE PREFERRED EMBODIMENTS

Figure 6:
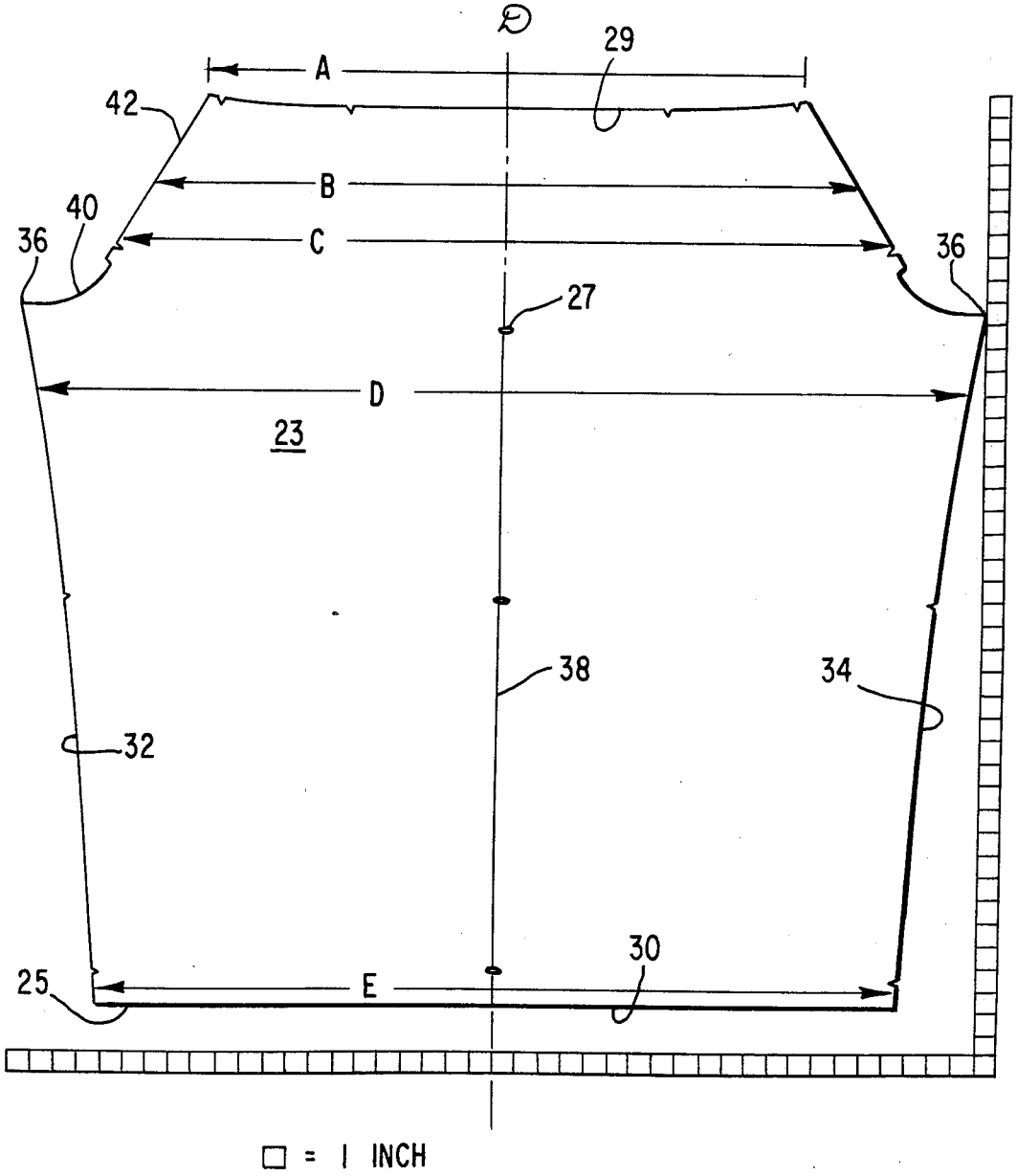
FIG. 6 is a plan view, to scale as depicted, showing the precise configuration of a blank used in accordance with the invention to manufacture a woman's size 8 petite pant with a back zipper and no front seam or outseam.

The forming method of the present invention may utilize a wide variety of cloth materials, such as that woven or knitted from man-made or natural yarns or fibers, including nylon, polyester, acrylic, linen, cotton, rayon, wool, silk or blends of these articles. The present invention is particularly well suited to molding woven fabrics, but its advantages apply to knitted fabrics as well. The invention is, however, limited to the treatment of unfinished cloth. Thus, the cloth that is used to construct the shells that are subsequently tensioned and treated is unfinished. In the context of the present invention, "unfinished cloth" is intended to mean cloth that has not been subjected in the flat to any of the conventional treatments intended to impart to the cloth a permanent dimensional or shape memory or to set or fix the intersections of the yarn. For example, common finishing procedures such as tentering, crabbing, preshrink processes, chemical cross-linking processes and others well known in the art are not to be performed on the cloth prior to its use in practicing the present invention, to the extent that such procedures impart a permanent dimensional or shape memory to the cloth. On the other hand, "finished cloth" is intended to mean cloth that has been subjected to such permanent dimensional and shape memory procedures. Since unfinished cloth is employed in the process of the present invention, in practice, any thermoplastic synthetic cloth used will be exposed to its highest processing temperature while maintained in contour on the mold.

In accord with a preferred embodiment of the invention, the cloth is subjected to a special treatment in the flat prior to use in the molding process in order to achieve a superior appearance free from even incidental wrinkling. In this preconditioning step, the cloth is lightly tensioned in the warp direction but left without tension in the fill direction and then heated to an elevated temperature, but one that is below the heat set temperature or conventional tentering temperature of the cloth. It has been found that this preconditioning of the cloth prior to the molding process eliminates any light wrinkling that might otherwise appear in the finished garment.

The use of finished cloth—that which has been treated in the flat to impart dimensional memory to the cloth—is unacceptable for a number of reasons. First, since the dimensional memory is set with the goods flat, the resetting of the cloth in contour is made more difficult, if not impossible. Second, finished goods have less inherent stretch than unfinished goods and, therefore, finished-cloth shells are very difficult to place on a mold having a similar size and shape. And third, unfinished cloth shells, having yarn intersections that are free to move in both direction and dimension, can be properly orientated on the mold with the cloth distributed generally uniformly and without wrinkles, whereas finished cloth shells with relatively fixed yarn intersections prove difficult, if not impossible, to orientate without wrinkles on the mold. As a consequence, the use of finished cloth has proven to be unworkable in the practice of the present invention.

It is highly desirable in the practice of the method of the present invention to maintain the preformed cloth shell under at least uniform circumferential tension while it is set to the desired three-dimensional shape. In fact, the advantages which result from the practice of the present invention derive in large measure from the recognition that a superior garment can be fabricated by placing the unfinished cloth shell in generally uniform tension and then subjecting it to an appropriate finishing, tentering or heat setting treatment. The actual amount of tension required will depend on the nature of the fabric being molded, although in general only minimal tension will suffice as long as it is distributed generally evenly at least in a circumferential direction throughout the shell.

The required shell tension may be produced by either stretching the shell over a mold of fixed dimension, by placing the shell on an expandable mold which is subsequently expanded or by placing the shell on a mold and subsequently shrinking the shell. The latter two of these techniques is preferred since they reduce the cycle time of the process by facilitating the placement and/or removal of the shell from the mold.

An exemplary expandable mold for use in forming a pant garment is shown in FIG. 1 and is designated generally as 10. The mold 10 includes front and rear portions, 12 and 14 respectively, which are mechanically joined and capable of expansion along parting line 16. The mold is shaped to faithfully conform to the size and shape of the actual garment to be produced and includes edges 18 to form appropriate creases in the garment. The mold 10 can be made from a variety of materials, including metals, plastics, ceramics or even wood. The mold may also be perforated or constructed from screening. While the particular material is not important to the practice of the invention generally, mold material may be relevant to specific processing parameters in a specific application. For example, heat insulating materials may be preferred for heat setting processes, and a specific mold material may be required when it is contemplated that various dye solutions, and other chemical agents may be applied to the shell while on the mold.

The specific details of the mechanical structure used to support, expand and retract the mold 10 and portions 12 and 14 does not form a part of the present invention and it is not illustrated in the drawing. A preferred embodiment of such structure, however, is disclosed in a related U.S. application Ser. No. 400455 filed July 21, 1982, and entitled Expandable Fabric Mold, the disclosure of which is incorporated herein by reference.

The cloth shell utilized in the practice of the present invention is constructed from a blank 20, shown in FIG. 2. The blank is designed to ultimately arrive at a shell having a shape which conforms to the contours of the mold and a size which will accommodate the mold on which it is finished. For example, if a fixed mold is used, the cloth shell will have a size slightly smaller than that of the mold. When using an expandable mold like that shown in FIG. 1, the shell has a size equal to or larger than the retracted mold but smaller than the mold when expanded. The shell must, however, have a shape that approximates or conforms to the shape of the mold in order to avoid undesirable variations in tensioning in different parts of the garment during the finishing or setting treatment.

This is achieved by designing the blank 20 (and thus the preformed shell) to have dimensions that duplicate or closely approximate the circumferential dimensions of the mold. By way of example, a typical women's size 10 pant has industry-accepted dimensions as follows:

| | |
|---|---|
| Waist | 26" |
| High Hip (4¼" below waist) | 34.5" |
| Low Hip (6½" below waist) | 37" |
| Thigh (2" below crotch) | 22½" |
| Bottom (Lowest circumference of each leg) | 21" |

For this garment, the mold dimension in the collapsed or closed position are approximately as follows: (assuming a uniform mold expansion of 0.78"):

| | |
|---|---|
| Waist | 24.44" |
| High Hip | 32.94" |
| Low Hip | 35.44" |
| Thigh | 20.94" |
| Bottom | 19.44" |

A blank used with this mold to produce the specified size 10 garment would have dimensions, not including seam allowances, as follows (the letter references appear on FIG. 6 to show the particular dimension on the blank):

| | |
|---|---|
| Waist (A) | 24.44" |
| High Hip (B) | 32.94" |
| Low Hip (C) | 35.44" |
| Thigh (D) | 41.88" |
| Bottom (E) | 38.88" |

These blanks and mold dimensions, coupled with a total mold expansion of 1.56" will result in a fabric extension of from about 6% at the waist, to 4.2% at the lower hip and 7.4% at the bottom.

Alternatively, the blank can be dimensioned, without seam allowances, as follows:

| | |
|---|---|
| Waist (A) | 24.07" |
| High Hip (B) | 31.94" |
| Low Hip (C) | 34.96" |
| Thigh (D) | 41.66" |
| Bottom (E) | 38.88" |

A shell constructed from this blank, when expanded on a mold of the dimensions stated previously, will also result in a size 10 pant, and in this case the fabric expansion is 8% circumferentially at each of the five specified garment locations.

From this foregoing explanation, it will be apparent that "generally uniform tensioning," as used in the context of the present invention, is intended to denote an expansion of the fabric—at least in the circumferential direction—within a narrow range of variation. Therefore, small variances in the expansion of the fabric throughout the garment (for example fabric expansion in range of about 4% to about 12% in the garment) will provide the requisite "generally uniform tensioning" for producing garments with suitable feel, look and dimensional stability characteristics.

FIG. 3 illustrates the manner in which the blank 20 is formed into the cloth shell. In this particular illustrated embodiment, the garment is a pant and it will have only an inseam on the legs and a front seam. A waistband 22 and other final trim are also applied to the shell before processing on the mold.

FIGS. 2 and 3 of the drawings are only intended to illustrate the general design principles employed in constructing a cloth shell for use in the practice of the present invention. The specific dimensions of blank 20, of course, will vary depending upon the particular garment being formed, and FIGS. 2 and 3 do not purport to precisely illustrate such specific dimensions.

FIG. 6, on the other hand, illustrates, on the scale depicted in the drawing, the specific shape and dimension of a blank 23 used to manufacture a woman's size 8 petite pant. The particular garment made from this blank will have only a back seam—using a zipper fitting if desired—and an inseam along each leg of the pant. There are no darts, front seam, or outseam in the finished garment. The blank 23 is cut along its centerline from its bottom edge 25 to point 27 and then assembled to form a shell in the same manner as depicted in FIG. 3.

As is apparent from FIG. 6, the one-piece pattern on blank 23, used for producing a pant garment, includes an upper edge 29, a lower edge 30, and side edges 32 and 34 each having a point 36 which ultimately forms a part of the crotch of the pant (thus points 36 are denoted as crotch points). It has been found that to obtain the properly configured preformed shell, the transverse dimension of the blank must increase from the lower edge 30 to crotch points 36 and then decrease from the crotch points to the upper edge 29. The blank 23 also includes a central cut at 38 that extends to the inner crotch point 27. Finally, the side edges also include a curved portion 40 and straight portion 42 intermediate crotch points 36 and upper edge 29. Given these size and shape parameters, a suitable preformed cloth shell can be fabricated for use in producing pant garment.

One of the significant advantages to the use of the expandable mold in the practice of the present invention is that process cycle time is reduced by facilitating the placement of the shell onto the mold and its removal from the mold due to the relatively small size of the mold when retracted. In other words, a great deal of time and effort is required to stretch the shell over a fixed-size mold, and this problem is eliminated with the expandable mold.

In accordance with the present invention, the cloth shell is treated while maintained in tension on the mold to set the cloth, that is, to impart to the fabric a permanent shape and dimensional stability or memory. As mentioned previously, the treating step may include heating the shell or applying chemical agents or other well known finishing procedures.

Heat setting of the shell on the mold may be accomplished by passing the mold and mounted cloth shell through an oven at a temperature sufficient to heat the shell above its heat set threshold, which varies with the nature of the shell fabric. Alternatively, the mold itself may house heating elements, such as resistance wire or infra-red calrod heaters. In yet another approach, heating liquids or high pressure steam may be circulated through or around the mold and shell in order to raise the temperature of the shell above its heat set threshold.

It is also necessary in accord with the present invention to leave the tensioned shell on the mold until it cools sufficiently to insure that it will retain its heat set shape. For example, when forming garments from woven polyester, it has been found that the shell retains its dimensional stability when removed from the mold at temperatures approximately 75 degrees—125 degrees Fahrenheit below the heat set temperatures. Of course, the specific temperature to which the garment should be cooled will depend upon the particular cloth employed in practicing the invention. Also, in order to expedite the garment forming cycle, cooling may be enhanced by passing cooling fluids through or around the mold.

As noted above, the use of expandable mold 10 greatly facilitates the practice of the present invention. FIGS. 4 and 5 serve to illustrate the expansion of the mold 10 with a cloth shell 24 properly positioned over it. The mold and shell are dimensioned such that the shell will rest on the mold as shown in FIG. 4 to permit uniform distribution of the shell on the mold. Once the shell has been properly oriented, the mold is expanded as shown in FIG. 5 to tension the cloth shell to give it a smooth, unwrinkled and finished appearance. The ammount of expansion will vary depending on the type of cloth used and will be apparent to those skilled in the art. For example, a conventional tentering process for common woven polyester fabrics will tension the cloth such that its dimension will increase by about 8%. Thus, the expansion of the mold when practicing the present invention can be set to increase the circumferential dimension of the mold and shell by a like 8%.

In addition to the heating procedure disclosed above, other finishing or setting techniques are well known to those skilled in the art and may be employed in the practice of the present invention.

For example, resins or swelling agents can be applied to the shell while on the mold by dipping the entire mold and shell into a bath of the particular chemical being used, removing the shell and mold from the bath and drying. Alternatively, the chemical may be sprayed onto the mold mounted shell before the drying step. The desired chemical set may be obtained using a wide variety of different synthetic resins conventionally utilized in finishing the fabrics at the mill before they are cut and sewn or welded into garments. For example, chemicals typically utilized to impart crease resistance to fabrics may be applied to the cloth shell while on the mold using impregnating resins which cross link with the molecules of the fiber of the fabric. Another class of chemical setting agents are the fluoro compounds used to provide water repellant finishes. Moreover, the present invention is not intended to be limited to any particular heat or chemical setting processes. Rather, the present invention is directed to the application of any finishing step which will effect shape and dimensional memory in the preformed cloth shell while it is tensioned on the mold.

As noted previously, the process of the present invention also contemplates that the garment may be not only dimensionally set on the mold, but also dyed on the mold. Thus, greige goods that have not been tentered or dyed may be cut into a properly shaped blank, formed into a specifically configured shell, mounted onto a suitable mold and then dyed and set to provide a finished garment. Any of the commonly used and conventional dyeing techniques known in the art may be employed in accordance with this aspect of the present invention. This approach has the advantage that the garment manufacturer may inventory the greige goods and then color the garments during manufacture to match the given demands of the marketplace. In addition, the garment will exhibit a greater color uniformity at the seam lines. The sequence of processing (i.e. dyeing and then setting, vice-versa or simultaneous) will depend upon the specific fabric used in the process and the processing capabilities of the garment manufacturer. Where the dyeing procedures employ temperatures above the fabric's heat-set temperature, the dyeing and heat-setting steps may be advantageously effected simultaneously.

Although any number of conventional dyes and dye baths may be used in the practice of the present invention, including, for example, those disclosed in U.S. Pat. Nos. 4,032,291; 2,881,045; 3,932,128; 2,833,613; 3,973,907; 3,917,447; 3,762,864 and 3,766,126, it has sometimes been found desirable in the practice of the present invention to chemically treat the greige goods to lower their heat history characteristics and hence to lower the temperature at which the fibers making up the greige goods will absorb dye. One such chemical treatment step is described in U.S. Pat. No. 4,293,305, the disclosure of which is incorporated herein by reference. It should be noted, of course, that such chemical pretreatment is not necessary in all cases and that dyeing of the unfinished garment can be accomplished without any such pretreatment.

One particularly desired technique for simultaneously dyeing and finishing a polyester garment on a mold requires the construction of a preformed shell of cloth, as described above, from unfinished and undyed greige goods, the optional pretreatment of the cloth shell, either before or after it is put in shell form, in the manner and with the chemical agents in U.S. Pat. No. 4,293,305, and the immersion of the preformed shell, while on a mold, in a hot bath of dye. The preformed shell so treated is simultaneously tentered, because of the elevated temperatures and inherent tension applied, and dyed. Alternatively, the chemical agents disclosed in U.S. Pat. No. 4,293,305 may be incorporated in the dye bath and all the processing is effected in a single immersion step.

In summary, the preformed cloth shell may be treated while tensioned on the mold in a variety of ways to set and complete the finishing of the cloth in the desired predetermined shape. The particular treatment employed will, of course, depend on the kind of cloth used in the process. For example, synthetics such as polyester, nylon and acrylic may be effectively set by use of a tentering treatment; cotton cloth may be set by tentering and/or ammonia swelling processes; and wool by tentering or crabbing, dry finishing and decating. Those skilled in the art will appreciate, however, that many other setting treatments may be employed.

Various facets of the practice of the method of the present invention will be described in Examples 1 to 4 and 6 below. In addition, the excellent dimensional stability of molded articles produced according to the teaching of the present invention will be described in Example 5. These Examples are all intended to be illustrative of the present invention, and not to be limiting in any way. Moreover, Example 7 illustrates an attempt to manufacture a garment in accordance with the teachings of one prior art patent, U.S. Pat. No. 3,763,499 issued to Bartos et al., and describes the results of work conducted which evidence the inferiority of the prior art process when compared to the present invention.

EXAMPLE 1

A textured polyester woven gabardine cloth (12 oz. per linear yard) was dyed and dried without tentering and cut in the form of a blank as shown in FIG. 2. The blank was then formed into a shell as shown in FIG. 3, final stitched along the pant inseam and front seam, and fitted with waistband, zipper and appropriate trim. The resulting cloth shell was of a shape that conformed generally to the contour of a mold of a kind similar to that shown in FIG. 1 and having a size corresponding to a ladies size 8 petite pant. The mold was constructed of metal and was preheated to 225 degrees F. The cloth blank was then placed over the mold and properly oriented on the mold such that the cloth was uniformly distributed over the mold. The mold was then expanded along its center part line such that the mold's circumference increased at the hip area approximately 1.2 inches. As a result, the cloth shell was uniformly tensioned giving the garment a finished appearance free from all wrinkles. The mold and tensioned shell were then passed through a hot air oven at a temperature of approximately 350 degrees Fahrenheit for a period of about 7 minutes and then cooled for approximately 2 minutes until the shell temperature dropped to about 200–250 degrees F. At this point the mold was retracted and the finished garment removed from the mold. The garment required no further pressing or finishing, was accurately sized as a size 8 petite, was free from wrinkles and exhibited a superior shape and dimensional stability.

EXAMPLE 2

Each of the fabrics described below may be formed into a garment by the procedure followed in Example 1 except with regard to different setting treatments as noted:

(a) 100% Polyester, Polyester and Cotton Blends (at least 30% polyester), Polyester and Wool Blends (at least 50% polyester);

(b) Wool, and Wool and Polyester Blends (at least 50% wool). Cloth shells made of these fabrics and mounted under tension on a mold may be set by immersing the mold and shell in alternate baths of hot and cold water and then drying the garment while still on the mold. If necessary, the fabric can be decated before removing it from the mold;

(c) Cotton and Cotton and Polyester or Other Man-Made Fibers (at least 70% Cotton). Cloth shells of these fabrics, mounted under tension on the mold, may be set by immersing the mold and shell into a bath ammonia and then drying the fabric in a hot air oven.

The garments made in this manner exhibited the same quality and characteristics as did the garment made in Example 1.

EXAMPLE 3

A polyester greige woven fabric which has been bulked but not washed or dry cleaned, was set and dyed on the mold in the following manner. A preformed shell is constructed and mounted under generally uniform tension on a mold, which is preferably perforated, the mold and its shell are then slowly dipped into dye bath maintained at 190 degrees C. After thirty seconds, the mold and shell are removed from the bath and the fabric is rinsed, while it remains on the mold, in a cleaning solution to remove excess dye. The dyed and finished garment is then dried and removed from the mold.

EXAMPLE 4

A preformed trouser shell is constructed from a single-piece polyester cloth shell smaller but otherwise conforming to the shape of a mold.

The shell is pulled over the mold which is then expanded to place uniform tension throughout the shell. Heat setting is applied as discussed above in Example 1, and a finished attractive and stable pair of trousers is removed from the mold.

EXAMPLE 5

Three pairs of trousers were molded from unfinished but dyed woven polyester fabric. Tentering of trousers took place on the mold in accordance with the practice of the present invention. The trousers were heat set at the temperatures indicated below in TABLES I, II and III, and subjected to repeated washings to determine their dimensional stability. As is clear from the results reported in these tables, all three pairs of trousers exhibited outstanding shape stability. The total dimensional variation was $\frac{1}{8}$ inch in the waist, hip, thigh, hem and total stride and approximately $\frac{1}{4}$ inch in the inseam and outseam (Table I). Comparable dimensional variation was exhibited by the other trousers (Tables II and III). These dimensional variations are so small as to be within the margin for error of the measuring technique used, and demonstrate the superior shape and dimensional memory of the garments made in accord with the present invention. In addition, the general appearance of the samples establishes that tentering on the expanded mold is an effective method of finishing unfinished cloth shells.

TABLE I

| | General Appearance | | SLACK NO. 1* | | | | | | |
|---|---|---|---|---|---|---|---|---|---|
| | CREASE RETENSION | WRINKLE RESISTANCE | WAIST | HIP | THIGH | OPEN HEM | IN-SEAM | OUTSEAM | TOTAL STRIDE |
| Initial | Good | Good | 12½" | 17¼" | 10⅞" | 9¼" | 34½" | 44⅜" | 25⅝" |
| 1st Wash | No change | No change | 12⅜" | 17⅜" | 10¾" | 9¼" | 34⅛" | 44¼" | 25¼" |
| 2nd Wash | No change | No change | 12½" | 17⅜" | 10¾" | 9⅜" | 34⅛" | 44¼" | 25⅛" |
| 3rd Wash | No change | No change | 12½" | 17⅜" | 10⅞" | 9¼" | 34" | 44⅜" | 25⅜" |
| 5th Wash | No change | Some Loss | 12½" | 17⅜" | 10¾" | 9¼" | 34" | 44½" | 25¼" |
| 10th Wash | Wrinkle in crotch | Wrinkle down right leg | 12⅜" | 17¼" | 10¾" | 9⅜" | 34" | 44½" | 25⅜" |
| 15th Wash | Good | Wrinkle dis-appeared | 12⅜" | 17⅜" | 10¾" | 9⅜" | 34" | 44⅛" | 25¼" |

*Set at 360° F.; measurements at hip 8 inches below top of waist and at thigh 2 inches below crotch.

TABLE II

| | General Appearance | | SLACK NO. 2* | | | | | | |
|---|---|---|---|---|---|---|---|---|---|
| | CREASE RETENSION | WRINKLE RESISTANCE | WAIST | HIP | THIGH | OPEN HEM | IN-SEAM | OUTSEAM | TOTAL STRIDE |
| Initial | Good | Good except wrinkled fly | 12" | 17" | 10¾" | 9⅝" | 32 1/16" | 43⅜" | 27⅛" |
| 1st Wash | No change | No change | 12¼" | 17" | 10⅝" | 9⅝" | 32" | 43" | 27½" |
| 2nd Wash | No change | No change | 11⅞" | 17" | 10⅝" | 9⅝" | 32" | 43" | 26¾" |
| 3rd Wash | No change | No change | 12⅛" | 17" | 10¾" | 9⅝" | 32" | 43⅛" | 27" |
| 5th Wash | No change | Good | 12⅛" | 16⅞" | 10⅝" | 9⅝" | 32" | 43⅛" | 26⅞" |
| 10th Wash | Good | Good | 12" | 17" | 10⅝" | 9⅝" | 32" | 43⅛" | 27" |
| 15th Wash | Good | Good | 12" | 17" | 10⅝" | 9⅝" | 32" | 43⅛" | 27" |

*Set at 360° F.; measurements at hip 8 inches below top of waist and at thigh 2 inches below crotch.

TABLE III

| | General Appearance | | SLACK NO. 3*++ | | | | | | |
|---|---|---|---|---|---|---|---|---|---|
| | CREASE RETENSION | WRINKLE RESISTANCE | WAIST | HIP | THIGH | OPEN HEM | IN-SEAM | OUTSEAM | TOTAL STRIDE |
| Initial | Good | Good | 12½" | 17⅞" | 11⅛" | 9⅝" | 29½" | 40⅜" | 27⅜" |
| 1st Wash | No change | No change | 12⅞" | 17¾" | 11¼" | 9⅝" | 29¼" | 40¼" | 27¼" |
| 2nd Wash | No change | No change | 12⅜" | 17⅝" | 11⅛" | 9⅝" | 29¼" | 40⅜" | 27" |
| 3rd Wash | No change | No change | 12⅝" | 18" | 11¼" | 9½" | 29⅜" | 40⅜" | 27½" |
| 5th Wash | No change | No change | 12¾" | 17¾" | 11¼" | 9½" | 29¼" | 40½" | 27¼" |
| 10th Wash | Good | Wrinkle down left leg | 12⅞" | 17⅞" | 11⅛" | 9½" | 29¼" | 40⅜" | 27¼" |
| 15th Wash | Good | Good | 13" | 17⅞" | 11¼" | 9½" | 29¼" | 40⅜" | 27¼" |

*Set at 325° F.; measurements at hip 8 inches below top of waist and at thigh 2 inches below crotch.
++First eleven washings in 140° F. water in a hot wash and hot rinse followed by drying on permanent press setting; twelfth washing and thereafter water temperature was reduced to 100° F. and washing done in warm wash & cool rinse at same dryer setting: Note that this change eliminated undesirable creases.

EXAMPLE 6

A polyester woven gabardine cloth (12 oz. per linear yard) was dyed and subjected to treatment on a tentering machine wherein the cloth was tensioned in the warp direction but left without tension in the fill direction. The cloth was heated to a temperature in the range of about 275–325 degrees (below the conventional tentering temperature of 350 degrees F.) as it was processed on the machine. These preconditioned goods were then used to manufacture a garment by the procedure described in Example 1. The resulting garment required no further pressing or finishing, was accurately sized, and exhibited no wrinkles and a fine, finished appearance.

EXAMPLE 7

A shaping frame of the kind illustrated in FIGS. 16–18 of U.S.Pat. No. 3,763,499 was constructed, and a trouser garment was formed pursant to the teachings and FIGS. 1–5 of the patent. The cloth used was a stretched knit polyester, since shrinkable polyester fabric as described in the patent is not available in the United States. The garment was then molded at 350 degrees F. according to the teachings of the patent and the following observations noted:

When the garment was mounted on the mold, the stretch in the hip area was extreme. Wrinkles occurred around the waistband because the blank was cut to a dimension between the waist dimension and hip dimension to minimize the stretch in the hip area. The thigh was also stretched more than the bottom portion of the leg. This caused less density and there was less stretch left after molding in the hip and thigh areas.

When the finished pant was fitted to a manniquin, the crotch was not developed or formed properly; therefore, extreme wrinkling occurred all along the front of the pant extending from the crotch. This appearance was not acceptable. The leg creases extended to the waist line, front and rear, which isnot acceptable.

The pant was difficult to load because of the friction between the mold and fabric which was caused by the small blank that had to be stretched while being pulled onto the mold.

If the blank was made larger, the waist and legs would be too large, and without shrinkable polyester, would not conform to the mold.

This process has no commerical practicality and the resulting garment has little, if any, value as a saleable product.

Those skilled in the art will appreciate the significant advantages attendantto the practice of the present invention. The resulting garment with few seams and no darts provides a new "look" and gives fashion stylist new concepts to work with in designing new styles. For the first time, unfinished and woven cloth can be employed to form a completely finished garment. This advantage results from the use of the preformed shell which conforms to the shape of the mold and permits tentering of the unfinished, woven fabric while tensioned on the mold. Thus, a great variety of fabrics may be used in the mold-forming of garments that were heretofore considered unsuitable for such processes. Moreover, substantial savings can be achieved in the costs of manufacture by reducing waste, reducing cloth cutting and sewing and eliminating the need for darts, seam and final pressing. In addition, the final product exhibits an outstanding appearance, precise sizing and enhanced wearing comfort.

Those skilled in the art will also recognize that the present invention provides the further advantage of permitting relatively precise adjustment of the inherent stretch in the finished garment. Thus, by proper selection of shell size, mold size and shell expansion, the degree of stretch left in the finished garment can be increased or lessened depending on the preceived stretch requirements for the particular apparel. And this can be achieved without dependence upon the exact stretch characteristics of the goods supplied by the fabric mill.

While particular embodiments of the invention have been described above, it will be obvious to those skilled in the art that changes and modifications may be made therein without departing from the invention in its broader aspects, and therefore, the object of the appended claims is to cover all such changes and modifications which fall within the true spirit and scope of the invention.

We claim:

1. A molded pant constructed from a performed shell of unfinished woven cloth, which has been finished by tentering on a mold to maintain a predetermined three-dimensional shape conforming to the shape of the mold and wherein said pant has a single seam on its outer periphery and a seam along the inside of each leg thereof.

2. A method for fabricating a garment from cloth comprising:

(a) subjecting a performed cloth shell generally in the size and shape of the garment to one or more treatments to completely finish the cloth, said one or more treatments being carried out while maintaining the cloth shell in generally uniform tension on a mold in the final three-dimensional shape of the garment.

3. A method for fabricating a pant garment from cloth comprising:

(a) cutting a one-piece pattern from cloth in the flat; said pattern having an upper transverse edge, a lower transverse edge, and side edges each including a crotch point intermediate to said upper and lower edges; said pattern also having an increasing transverse dimension from said lower edge to said crotch points, a decreasing transverse dimension from said crotch points to said upper edge, and a central cut from said lower edge to a central crotch point;

(b) forming said one-piece pattern into a cloth shell; and (c) subjecting said cloth shell to one or more treatment to completely finish the cloth, said one or more treatments being carried out while maintaining the cloth shell on a mold in the final three-dimensional shape of the pant garment.

4. A one-piece pattern for use in fabricating a pant garment from cloth, comprising an upper transverse edge, a lower transverse edge and side edges extending between the upper and lower edges, each side edge including a crotch point; the transverse dimension of said pattern increasing from said lower edge to said crotch points and decreasing from said crotch points to said upper edge;and a central cut extending from the lower edge of said pattern to an inner crotch point.

5. The one-piece pattern of claim 4 wherein said side edges between said crotch points and the upper edge each includes a curved portion and a straight portion.

6. A one-piece pattern cut from flat cloth for use in producing a pant garment comprising:

(a) an upper waist area adjacent an upper transverse edge, a lower leg area adjacent a bottom transverse edge, and transversely extending hip and thigh areas positioned at selected locations between said upper and bottom edges;

(b) longitudinal side edges defined by the extremeties of said pattern; and (c) a central cut extending from said bottom edge toward said upper edge through said thigh area to define inner side edges on said pattern which can be joined to said outer side edges to form leg portions for said pant garment; and (d) said pattern being cut to have waist, hip, thigh and leg transverse dimensions such that uniform transverse tentering of the garment formed from said pattern expands each of said transverse dimensions a uniform selected percentage to a selected finished dimension.

* * * * *